US007938176B2

(12) United States Patent
Patel

(10) Patent No.: US 7,938,176 B2
(45) Date of Patent: May 10, 2011

(54) ANTI-EXTRUSION DEVICE FOR SWELL RUBBER PACKER

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/192,623

(22) Filed: Aug. 15, 2008

(65) Prior Publication Data

US 2010/0038074 A1 Feb. 18, 2010

(51) Int. Cl.
*E21B 33/127* (2006.01)

(52) U.S. Cl. ..... 166/187

(58) Field of Classification Search ..... 166/387, 166/179, 142, 196
See application file for complete search history.

(56) References Cited

U.S. PATENT DOCUMENTS

| | | | | |
|---|---|---|---|---|
| 3,358,766 | A * | 12/1967 | Current | 277/337 |
| 3,734,179 | A * | 5/1973 | Smedley | 166/106 |
| 4,267,401 | A * | 5/1981 | Wilkinson | 174/77 R |
| 4,809,201 | A | 2/1989 | Keklak | |
| 4,886,117 | A | 12/1989 | Patel | |
| 5,261,487 | A | 11/1993 | McLeod et al. | |
| 5,613,555 | A | 3/1997 | Sorem et al. | |
| 6,343,791 | B1 | 2/2002 | Anyan et al. | |
| 6,827,150 | B2 * | 12/2004 | Luke | 166/387 |
| 6,840,328 | B2 | 1/2005 | McKee et al. | |
| 7,331,581 | B2 | 2/2008 | Xu et al. | |
| 7,363,970 | B2 | 4/2008 | Corre et al. | |
| 7,422,071 | B2 * | 9/2008 | Wilkie et al. | 166/387 |
| 7,730,940 | B2 * | 6/2010 | Knippa et al. | 166/118 |
| 2004/0007366 | A1 | 1/2004 | McKee et al. | |
| 2004/0149429 | A1 | 8/2004 | Dilber et al. | |
| 2006/0219400 | A1 | 10/2006 | Xu et al. | |
| 2007/0012436 | A1 * | 1/2007 | Freyer | 166/179 |
| 2007/0056725 | A1 | 3/2007 | Lucas et al. | |
| 2007/0089877 | A1 | 4/2007 | Corre et al. | |
| 2007/0151724 | A1 | 7/2007 | Ohmer et al. | |
| 2007/0193736 | A1 | 8/2007 | Corre et al. | |
| 2008/0011471 | A1 | 1/2008 | Hughes et al. | |
| 2008/0023123 | A1 | 1/2008 | Downton et al. | |
| 2008/0023863 | A1 | 1/2008 | Lee et al. | |
| 2009/0283254 | A1 * | 11/2009 | Andersen et al. | 166/118 |

* cited by examiner

*Primary Examiner* — Kenneth Thompson
*Assistant Examiner* — James G Sayre
(74) *Attorney, Agent, or Firm* — Van Someren, PC; Rodney V. Warfford; Tim Curington

(57) ABSTRACT

A system for use in a wellbore is disclosed. The system may include a tube, a swell packer surrounding a portion of the tube, a first pair of plates coupled to an outer surface of the tube and positioned at a first end of the swell packer, each of the first pair of plates having a plurality of slots extending inwardly from an outer edge of the plate, the regions between slots defining petals, wherein at least one of the slots of one of the first pair of plates overlaps with at least one of the petals of the second of the first pair of plates, and a second pair of plates coupled to the outer surface of the tube and positioned at a second end of the swell packer, each of the second pair of plates having a plurality of slots extending inwardly from an outer edge of the plate, the regions between slots defining petals wherein at least one of the slots of one of the second pair of plates overlaps with at least one of the petals of the second of the second pair of plates.

13 Claims, 5 Drawing Sheets

ANTI-EXTRUSION DEVICE FOR SWELL RUBBER PACKER

BACKGROUND

Hydrocarbon fluids such as oil and gas are found in subterranean portions of geological formations or reservoirs. Wells are drilled into these formations for extracting the hydrocarbon fluids. Wells may be completed in a variety of ways including open hole and cased hole configurations. The processes involved in completing well bores and producing hydrocarbons from them often require isolation of one or more zones from another. For example, the well bore may pass through multiple production zones. In these applications, it may be desireable to isolate the non-productive regions located between the production zones. In particular, the annular region on a well bore disposed between the well bore wall (or casing) and the string may need to be isolated.

A variety of packers have been developed to isolate such regions. For example, mechanical, inflatable, chemical and pneumatic packers may be used. Such packers may respond to hydraulic pressure by expanding to fill the annulus. Swell rubber packers have been used that rely on an elastomeric material such as rubber and its tendency to swell in presence of hydrocarbons. Such packers have been disclosed in U.S. Pat. Publication No. 2007/0151723 by Freyer. These packers expand to fill an annulus when comes in contact with the wellbore fluids and have the advantage of not relying on separate actuation means or moving parts.

When the elastomer comprising the swell packer expands, the mechanical properties of the elastomer deteriorate and the packer weakens. As a result, the elastomer becomes prone to failure when exposed to high differential pressures. This may result in extrusion of the elastomer along the pressure gradient and the loss of the annular seal.

Accordingly, some packers have been provided with rigid, solid collars or rings placed at either end of the swell packer. Such devices may not reliably prevent extrusion as the variable diameter of a well bore may leave room between the collar and the wellbore wall that could allow for a portion of the elastomer to be extruded into the annular region above or below the packer. Also, such solid collars limit the ability to deploy intelligent completions devices such as fiber optic lines, wirelines, communications devices, sensors, and other such devices as the solid collar does not allow for deployment of such devices through the annular region.

Accordingly, there is a need for an anti-extrusion device for a swell packer that may reliably fill the annular region and prevent or limit extrusion under relatively high differrential pressures. There is also a need for an anti extrusion device that is capable of use while deploying intelligent well completions devices in conjunction with a swell packer.

SUMMARY

Some embodiments relate to a system for use in a wellbore. The system may comprise a tube, a swell packer surrounding a portion of the tube, a first pair of plates coupled to an outer surface of the tube and positioned at a first end of the swell packer, each of the first pair of plates having a plurality of slots extending inwardly from an outer edge of the plate, the regions between slots defining petals, wherein at least one of the slots of one of the first pair of plates overlaps with at least one of the petals of the second of the first pair of plates, and a second pair of plates coupled to the outer surface of the tube and positioned at a second end of the swell packer, each of the second pair of plates having a plurality of slots extending inwardly from an outer edge of the plate, the regions between slots defining petals wherein at least one of the slots of one of the second pair of plates overlaps with at least one of the petals of the second of the second pair of plates.

Other embodiments relate to a system for use in a wellbore comprising a tube, a swell packer surrounding a portion of the tube, a first pair of plates coupled to an outer surface of the tube and positioned at a first end of the swell packer, each of the first pair of plates having a plurality of slots extending inwardly from an outer edge of the plate, the regions between slots defining petals, wherein at least one of the slots of one of the first pair of plates overlaps with at least one of the petals of the second of the first pair of plates, and a second pair of plates coupled to the outer surface of the tube and positioned at a second end of the swell packer, each of the second pair of plates having a plurality of slots extending inwardly from an outer edge of the plate, the regions between slots defining petals wherein at least one of the slots of one of the second pair of plates overlaps with at least one of the petals of the second of the second pair of plates. A passage through the first pair of plates, the second pair of plates, and the swell packer may be provided, and a second tube disposed within the channel.

Yet other embodiments relate to a system for use in a well bore comprising a tube, and a swell packer surrounding a portion of the tube. A first anti-extrusion device may be disposed at a first end of the swell packer and a second anti-extrusion device disposed at a second end of the swell packer. A passage through the first anti-extrusion device, the swell packer and the second anti extrusion device may be provided and a communication line disposed within the passage.

DETAILED DESCRIPTION

Figure 1:
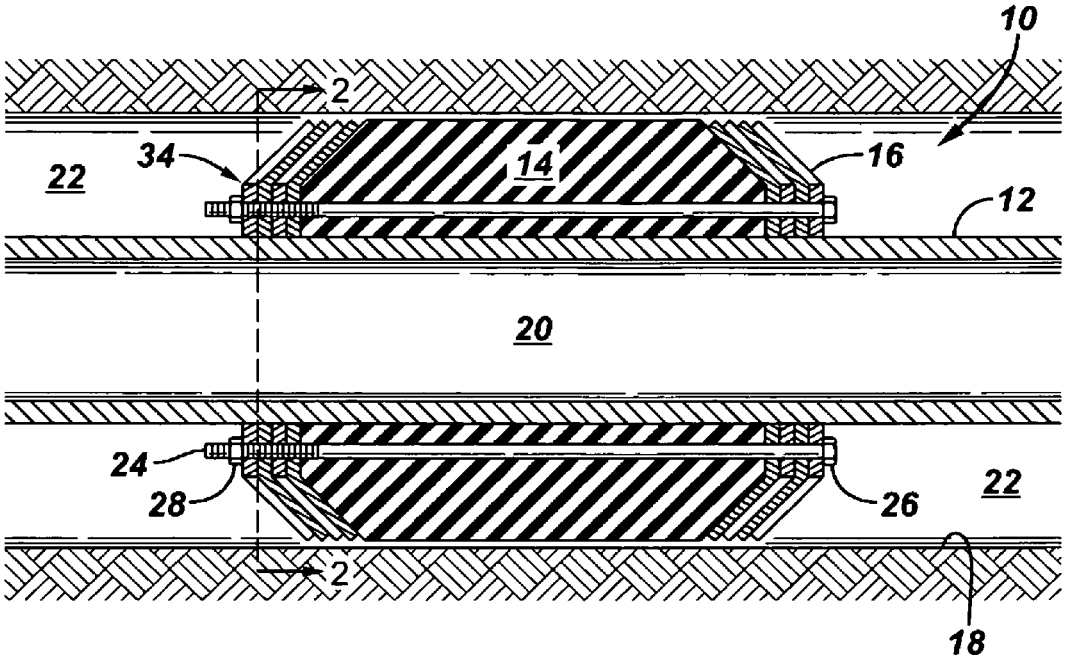
FIG. 1 is a cross sectional view of a system for use in a wellbore.
Figure 2:
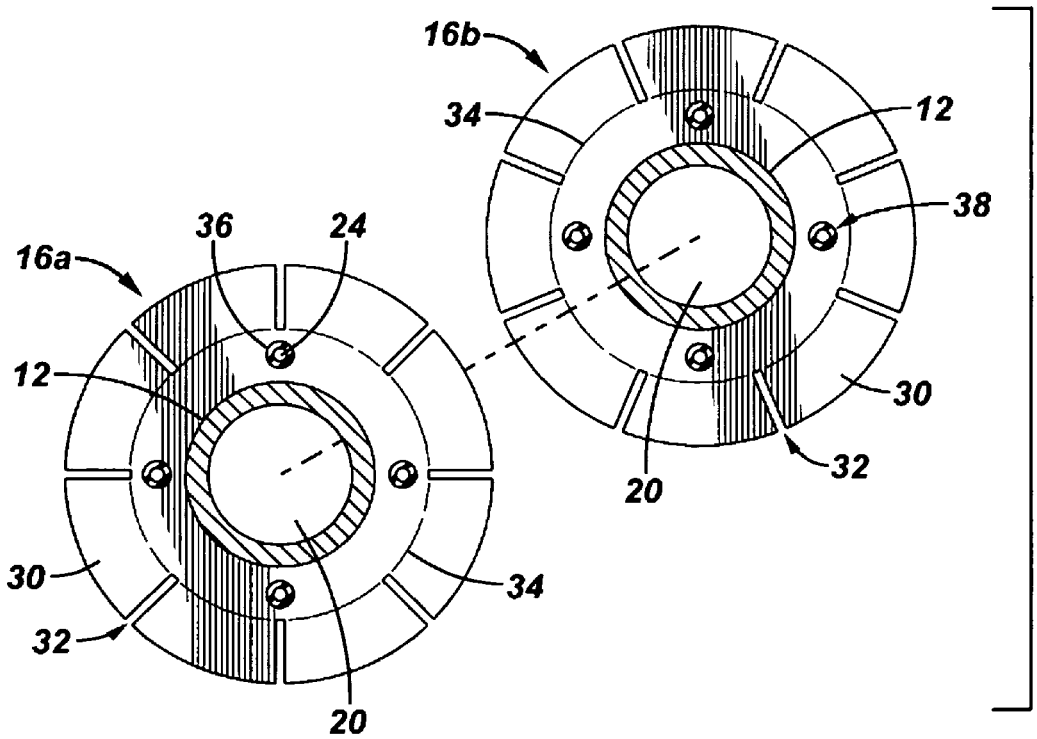
FIG. 2 is an end view of plates for use in the wellbore system of FIG. 1 taken along line 2-2.

Referring to FIGS. 1 and 2, a system 10 comprises a string 12, shown as a production tube, swell packer 14, and plates 16. Swell packer 14 may comprise an elastomeric material that will expand in the presence of hydrocarbons or specific fluid. Swell packer 14 is positioned along an outer surface of string 12 such that packer 14 is disposed between string 12 and a wall 18 to provide a flow region 20 and an annular region 22. When placed in or near a production zone, a portion of the hydrocarbons therein may be absorbed and cause swell packer 14 to expand and seal the annular region. Wall 18 may be a cement or other casing or may be the wall of an open hole. Coupler 24 may be used in conjunction with plates 16. Coupler 24 extends through a first set of plates, through the swell packer 14 and through the second set of plates. The coupler may be a rod and may be secured at a first end with a head 26 and at a second end with a fastener 28. Coupler 24 may be tensioned to resist movement of plates 16 along string 12 as packer 14 swells.

FIG. 2 shows two types of plates 16*a* and 16*b* that may be used to provide an extrusion barrier. Each of plates 16*a* and 16*b* include a plurality of petals 30. Each petal is positioned adjacent two slots 32. The petals are angled towards swell packer 14 from a deflection point 34. Seals 36 may be provided in apertures 38 to prevent extrusion between plates 16 and couplers 24. The position of apertures 38 relative to petals 30 may be varied such that the petals of plate 16*a* overlap the slots 32 of plate 16*b* and vice versa. The overlapping petals prevent extrusion of the elastomeric material through the slots 32. When positioned down hole, swell packer 14 will contact hydrocarbons and expand to fill the annular region. Unlike rigid collars that have been used to bound the lateral expansion of the packer, petals 30 of plates 16 may be deflected outward towards wall 18. This allows provides for a tight seal of the annular region and further restricts the extrusion of the elastomeric material. At least one of plates 16*a* and one of plates 16*b* are used at each end of swell packer 14. In other embodiments additional plates may be used depending on the pressures that will be encountered.

Figure 3:
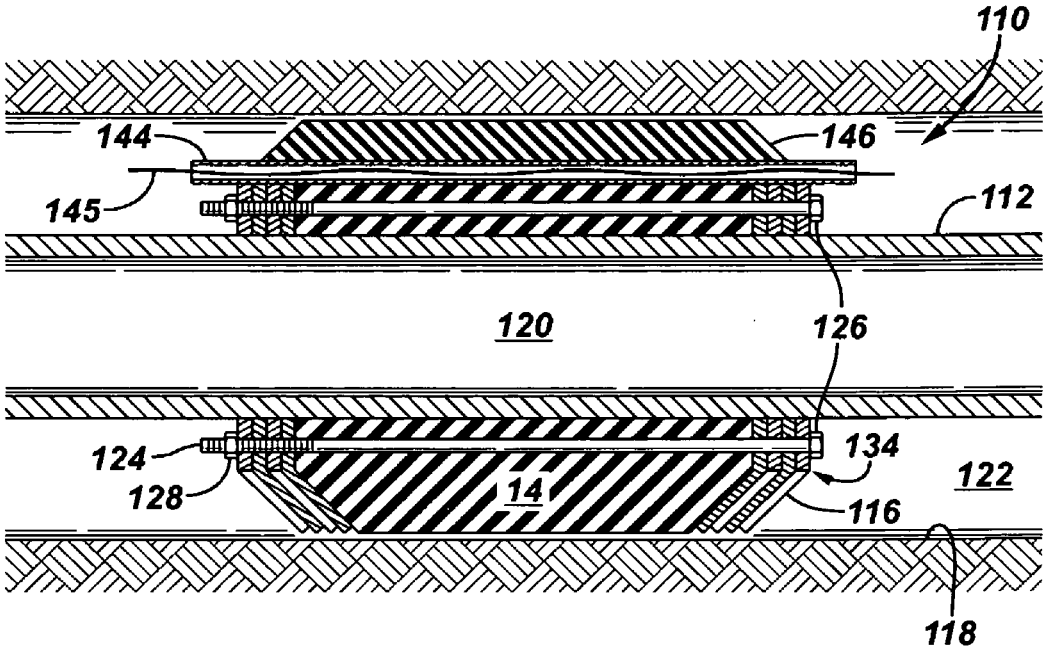
FIG. 3 is a cross sectional view of a system for use in a wellbore.
Figure 4:
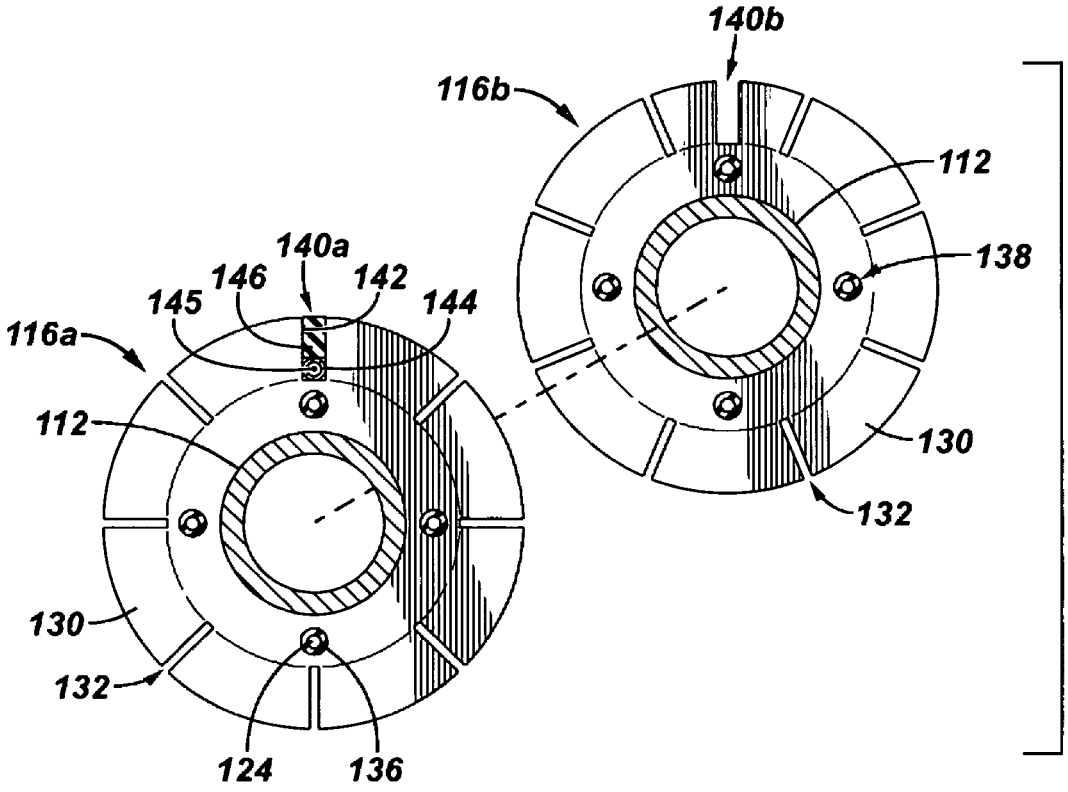
FIG. 4 is an end view of plates for use in the wellbore system of FIG. 3 taken along line 4-4.

Referring to FIGS. 3 and 4, a system 110 comprises a string 112, shown as a production tube, swell packer 114, and plates 116. Swell packer 114 may comprise an elastomeric material that will expand in the presence of hydrocarbons. Swell packer 114 is positioned along an outer surface of string 112 such that packer 114 is disposed between string 112 and a wall 118 to provide a flow region 120 and an annular region 122. When placed in or near a production zone, a portion of the hydrocarbons therein may be absorbed and cause swell packer 114 to expand and seal the annular region. Wall 118 may be a cement or other casing or may be the wall of an open hole. Coupler 124 may be used in conjunction with plates 116. Coupler 124 extends through a first set of plates, through the swell packer 114 and through the second set of plates. The coupler may be a rod and may be secured at a first end with a head 126 and at a second end with a fastener 128. Coupler 124 may be tensioned to resist movement of plates 116 along string 112 as packer 114 swells.

FIG. 4 shows two types of plates 116*a* and 116*b* that may be used to provide an extrusion barrier. Each of plates 116*a* and 116*b* include a plurality of petals 130. Each petal is positioned adjacent two slots 132. The petals are angled towards swell packer 114 from a deflection point 134. Seals 136 may be provided in apertures 138 to prevent extrusion between plates 116 and couplers 124. The position of apertures 138 relative to petals 130 may be varied such that the petals of plate 116*a* overlap the slots 132 of plate 116*b* and vice versa. The overlapping petals prevent extrusion of the elastomeric material through the slots 132. When positioned down hole, swell packer 114 will contact hydrocarbons and expand to fill the annular region. Unlike rigid collars that have been used to bound the lateral expansion of the packer, petals 130 of plates 16 may be deflected outward towards wall 118. This allows provides for a tight seal of the annular region and further restricts the extrusion of the elastomeric material.

In each of plates 16, a slot 140 is provided. In each of plates 16*a*, a slot 140 is positioned where on e of slots 132 would normally be positioned. In some embodiments slot 140*a* may be the same size and shape as slots 130. In other embodiments, as shown, slot 140*a* may be larger than one of slots 130. In each of plates 16*b*, slot 140*b* may be centered on a petal 130 relative to the arc of the petal, such that slots 140*a* and 140 line up to provide a passage 142 through the anti extrusion device. Tube 144 may be run through passage 142 to accommodate a communication line or other device. Cover 146 may be used to hold tube 144 in place relative to plate 16. Cover 146 may comprise the same swelling elastomeric material as packer 114 thus providing a passage along the whole length of swell packer 114. Alternatively, apertures may be provided in plates 16*a* and 16*b* to provide a passage.

Figure 5:
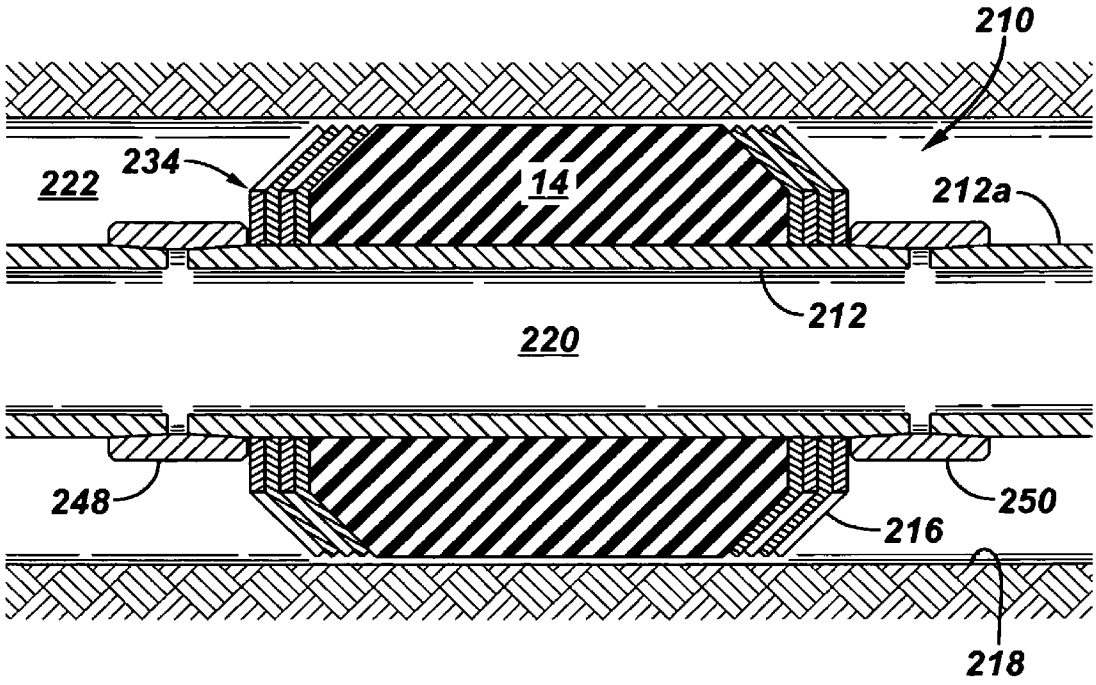
FIG. 5 is a cross sectional view of a system for use in a wellbore.
Figure 6:
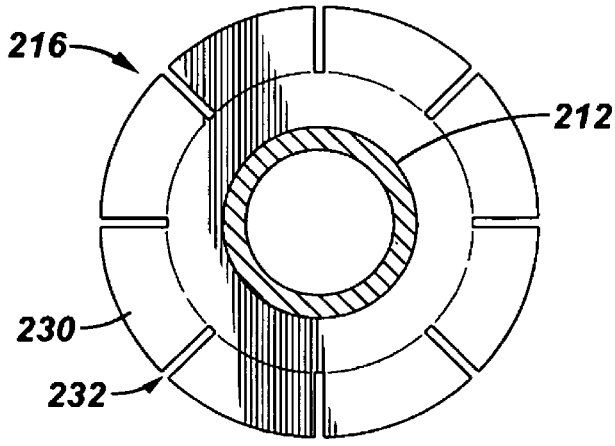
FIG. 6 is an elevation view of plates for use in the wellbore system of FIG. 5 taken along line 6-6

Referring to FIGS. 5 and 6, a system 210 comprises a string 212, shown as a production tube, swell packer 214, and plates 216. Swell packer 214 may comprise an elastomeric material that will expand in the presence of hydrocarbons. Swell packer 214 is positioned along an outer surface of string 212 such that packer 14 is disposed between string 212 and a wall 218 to provide a flow region 220 and an annular region 222. When placed in or near a production zone, a portion of the hydrocarbons therein may be absorbed and cause swell packer 214 to expand and seal the annular region. Wall 218 may be a cement or other casing or may be the wall of an open hole. Plates 216 may be positioned between swell packer 214 and couplers 248. Couplers 248 are configured to resist lateral movement of pates 216 relative to mandrel 212*a*. Couplers 248 may be threaded to mandrel 212*a* and tubing 212. FIG. 6 shows plate 216 that may be used to provide an extrusion barrier. Each of plates 216 include a plurality of petals 230. Each petal is positioned adjacent two slots 232. The petals are angled towards swell packer 214 from a deflection point 234. Alternating plates 216 may be positioned such that the petals 230 of one plate 216 overlap with the slots 232 of the adjacent plate 216. The overlapping petals prevent extrusion of the elastomeric material through the slots 232. When positioned down hole, swell packer 214 will contact hydrocarbons and expand to fill the annular region. Unlike rigid collars that have been used to bound the lateral expansion of the packer, petals 230 of plates 216 may be deflected outward towards wall 218. Alternately, a passageway and tube can be provided with same arrangement as shown in FIG. 3.

Figure 7:
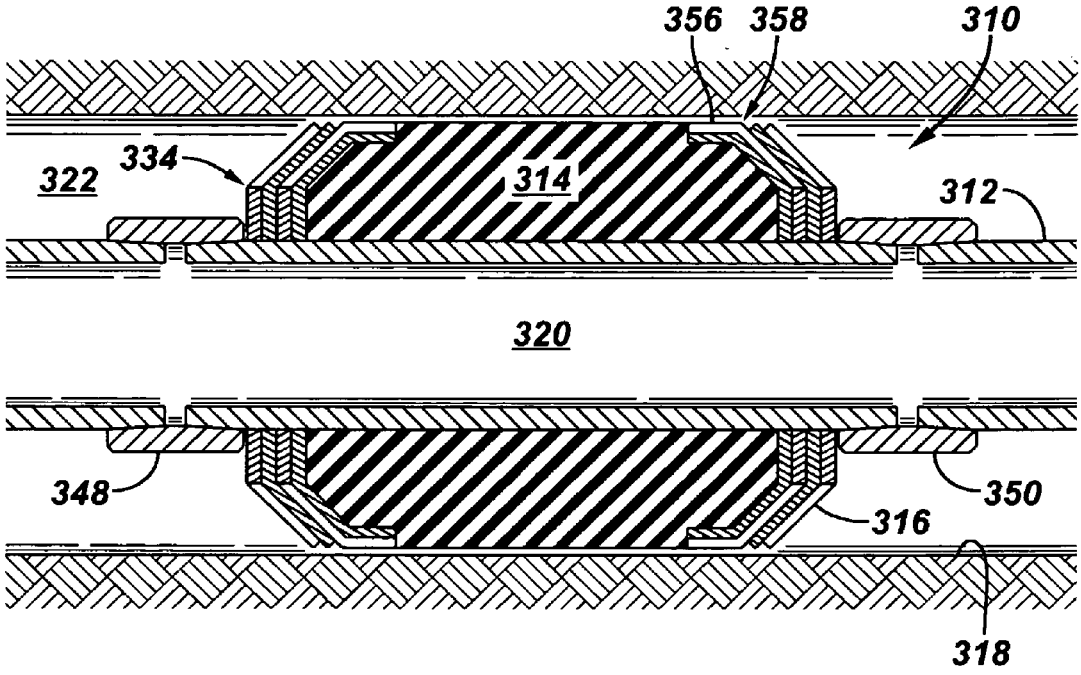
FIG. 7 is a cross sectional view of a system for use in a wellbore.

Referring to FIG. 7, a system 310 comprises a string 312, shown as a production tube, swell packer 314, and plates 316. Swell packer 314 may comprise an elastomeric material that will expand in the presence of hydrocarbons. Swell packer 314 is positioned along an outer surface of string 312 such that packer 314 is disposed between string 312 and a wall 318 to provide a flow region 320 and an annular region 322. When placed in or near a production zone, a portion of the hydrocarbons therein may be absorbed and cause swell packer 314 to expand and seal the annular region. Wall 318 may be a cement or other casing or may be the wall of an open hole. Plates 316 may be positioned between swell packer 314 and couplers 348. Couplers 348 are configured to resist lateral movement of pates 316 relative to mandrel 312*a*. Couplers 350 may be threaded to mandrel 312*a* and tubing 312. One or more of plates 316 positioned closes to swell packer 314 may be provided with extensions 356 which extend roughly parallel to tube 312 and extend from a deflection point 358. Extensions 356 may serve to further reduce extrusion of the elastomer material past plates 316.

Figure 8:
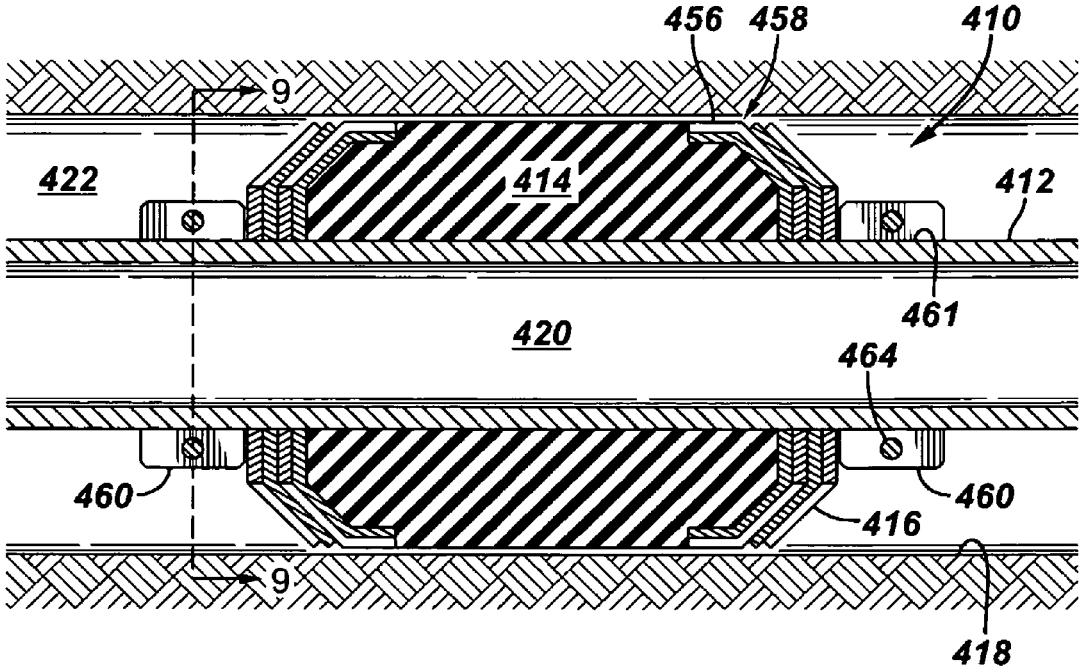
FIG. 8 is a cross sectional view of a system for use in a wellbore.
Figure 9:
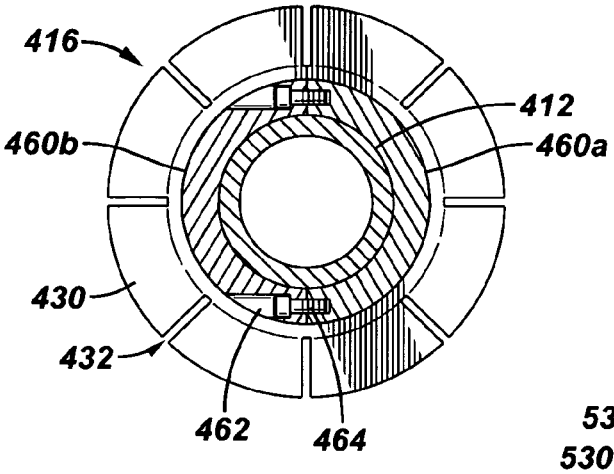
FIG. 9 is an elevation view of plates for use in the wellbore system of FIG. 8 taken along line 9-9.

Referring to FIGS. 8 and 9, a system 410 comprises a string 412, shown as a production tube, swell packer 414, and plates 416. Swell packer 414 may comprise an elastomeric material that will expand in the presence of hydrocarbons. Swell packer 414 is positioned along an outer surface of string 412 such that packer 414 is disposed between string 412 and a wall 418 to provide a flow region 420 and an annular region 422. When placed in or near a production zone, a portion of the hydrocarbons therein may be absorbed and cause swell packer 414 to expand and seal the annular region. Wall 418 may be a cement or other casing or may be the wall of an open hole. Plates 216 may be positioned between swell packer 414 and couplers 460. Couplers 460 are configured to resist lateral movement of pates 416 relative to tube 412. An inner surface of couplers 46 contacts an outer surface of tube 412 at a region 462. The region 462 may be knurled or otherwise textured to provide increased friction between couplers 460 and tube 412. Couplers 460 comprise first half 460*a* and a second half 460*b*. Second half 460*b* may be provided with recesses 462 to accommodate bolts 464 which may be used to secure first half 460*a* to second half 460*b*. Alternatively, a single recess may be positioned on each half in which case the halves 460*a* and 460*b* could be identical.

One or more of plates 416 positioned closes to swell packer 414 may be provided with extensions 456 which extend roughly parallel to tube 412 and extend from a deflection point 458. Extensions 456 may serve to further reduce extrusion of the elastomer material past plates 416.

Figure 11:
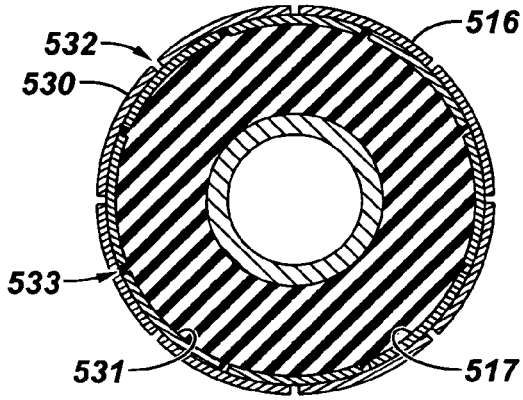
FIG. 11 is an elevation view of plates for use in the wellbore system of FIG. 10 taken along line 11-11.
Figure 10:
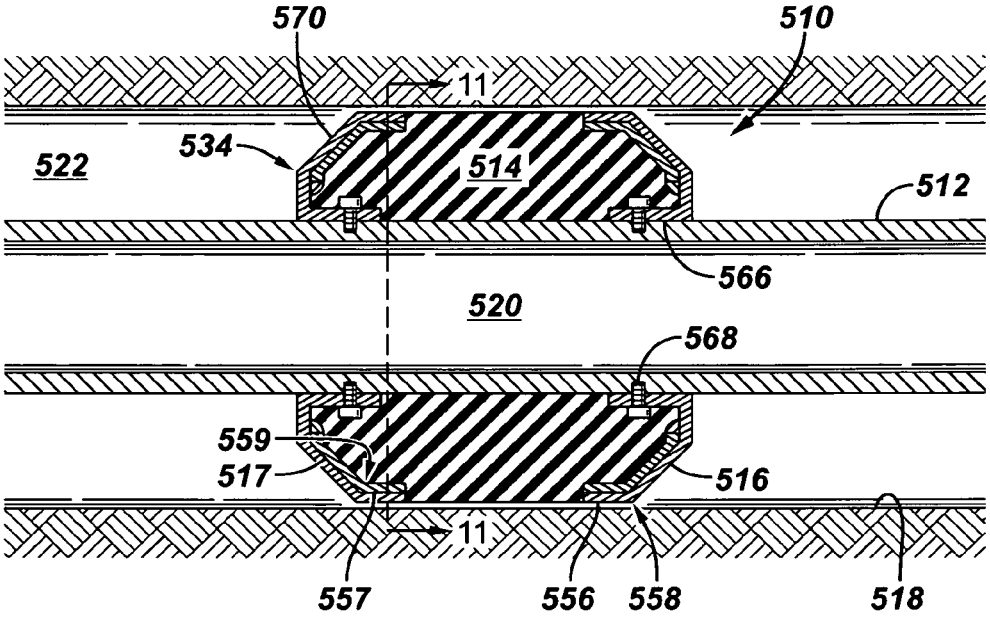
FIG. 10 is a cross sectional view of a system for use in a wellbore.

Referring to FIGS. 10 and 11, a system 510 comprises a string 512, shown as a production tube, swell packer 514, and plates 516 and 517. Swell packer 514 may comprise an elastomeric material that will expand in the presence of hydrocarbons. Swell packer 14 is positioned along an outer surface of string 512 such that packer 514 is disposed between string 512 and a wall 518 to provide a flow region 520 and an annular region 522. When placed in or near a production zone, a portion of the hydrocarbons therein may be absorbed and cause swell packer 514 to expand and seal the annular region. Wall 518 may be a cement or other casing or may be the wall of an open hole. Plates 517 may be joined to plates 516 at a point near deflection point 534 of plate 516. Plates 517 may be positioned on the side of plate 516 adjacent to the elastomer material.

Plates 516 may include an extension 566 extending parallel to tube 512 and may be coupled to tube 512 by fastener 568. Alternatively, plate 516 may be welded or otherwise coupled to tube 512. Plate 516 also includes a lateral extension 556 which extends from a deflection point 558. Plate 517 may extend roughly parallel to portion 570 of plate 516 and comprise an extension 557 that extends roughly parallel to extension 556 from deflection point 559. Plate 516 includes petals 530 separated by slots 532. Likewise, plate 517 includes petals 531 separated by slots 533. Plates 516 and 517 are configured such that the petals of one plate overlap the slots of the other.

Although the foregoing has been described with reference to exemplary embodiments, workers skilled in the art will recognize that changes may be made in form and detail without departing from the spirit and scope thereof. For example, although different example embodiments may have been described as including one or more features providing one or more benefits, it is contemplated that the described features may be interchanged with one another or alternatively be combined with one another in the described example embodiments or in other alternative embodiments. The present subject matter described with reference to the example embodiments and set forth in the following claims is manifestly intended to be as broad as possible. For example, unless specifically otherwise noted, the claims reciting a single particular element also encompass a plurality of such particular elements. Many other changes and modifications may be made to the present invention without departing from the spirit thereof. The scope of these and other changes will become apparent from the appended claims. The steps of the methods described herein may be varied, and carried out in different sequences.

What is claimed is:

1. A system for use in a wellbore, comprising:

a tube;

a swell packer surrounding a portion of the tube;

a first pair of plates coupled to an outer surface of the tube and positioned at a first end of the swell packer, each of the first pair of plates having a plurality of slots extending inwardly from an outer edge of the plate, the regions between slots defining petals, wherein at least one of the slots of one of the first pair of plates overlaps with at least one of the petals of the second of the first pair of plates;

a second pair of plates coupled to the outer surface of the tube and positioned at a second end of the swell packer, each of the second pair of plates having a plurality of slots extending inwardly from an outer edge of the plate, the regions between slots defining petals wherein at least one of the slots of one of the second pair of plates overlaps with at least one of the petals of the second of the second pair of plates;

a coupler comprising a member extending from the first pair of plates to the second pair of plates; and a passage through the first pair of plates, the second pair of plates, and the swell packer, the passage being formed through the first pair of plates and the second pair of plates by aligning an opening in each plate of the first pair of plates and each plate of the second pair of plates, the passage being a slot extending radially inward into the first and second pairs of plates.

2. The system of claim 1, wherein the petals of the first pair of plates are angled toward the second pair of plates.

3. The system of claim 2, wherein the petals of the second pair of plates are angled toward the first pair of plates.

4. The system of claim 1, wherein the opening in each plate is centered through a petal.

5. The system of claim 4, further comprising a second tube disposed within the passage.

6. The system of claim 4, further comprising a communication line disposed in the passage.

7. The system of claim 1, further comprising additional plates positioned proximate to the first and second ends of the swell packer.

8. A system for use in a well bore comprising:

a tube;

a swell packer surrounding a portion of the tube;

a first pair of plates coupled to an outer surface of the tube and positioned at a first end of the swell packer, each of the first pair of plates having a plurality of slots extending inwardly from an outer edge of the plate, the regions between slots defining petals, wherein at least one of the slots of one of the first pair of plates overlaps with at least one of the petals of the second of the first pair of plates;

a second pair of plates coupled to the outer surface of the tube and positioned at a second end of the swell packer, each of the second pair of plates having a plurality of slots extending inwardly from an outer edge of the plate, the regions between slots defining petals wherein at least one of the slots of one of the second pair of plates overlaps with at least one of the petals of the second of the second pair of plates;

a passage through the first pair of plates, the second pair of plates, and the swell packer;

a second tube disposed within the passage; and an elastomeric material disposed in the passage to secure the second tube in place.

9. The system of claim 8, wherein the petals of the first pair of plates are angled toward the second pair of plates.

10. The system of claim 8, wherein the second tube is at least partially secured within the passage by a swelling elastomer.

11. The system of claim 10, further comprising a communication line disposed in the second tube.

12. The system of claim 8, wherein the petals of the first pair of plates are angled toward the second pair of plates.

13. A system for use in a well bore comprising:

a tube;

a swell packer surrounding a portion of the tube;

a first anti-extrusion device disposed at a first end of the swell packer, the first anti-extrusion device comprising a first pair of plates coupled to an outer surface of the tube and positioned at a first end of the swell packer, each of the first pair of plates having a plurality of slots extending inwardly from an outer edge of the plate, the regions between slots defining petals, wherein at least one of the slots of one of the first pair of plates overlaps with at least one of the petals of the second of the first pair of plates;

a second anti-extrusion device disposed at a second end of the swell packer, the second anti-extrusion device comprising a second pair of plates coupled to the outer surface of the tube and positioned at a second end of the swell packer, each of the second pair of plates having a plurality of slots extending inwardly from an outer edge of the plate, the regions between slots defining petals wherein at least one of the slots of one of the second pair of plates overlaps with at least one of the petals of the second of the second pair of plates;

a passage through the first anti-extrusion device, the swell packer and the second anti extrusion device, the passage being formed as a slot extending radially inward into the first anti-extrusion device and the second anti-extrusion device; and a communication line disposed within the passage.

* * * * *